US007240795B2

(12) United States Patent
Lee

(10) Patent No.: US 7,240,795 B2
(45) Date of Patent: Jul. 10, 2007

(54) MULTIPLE COMPARTMENT PILL DISPENSER

(76) Inventor: James M. Lee, 514 Joyce St., Orange, NJ (US) 07050

( * ) Notice: Subject to any disclaimer, the term of this patent is extended or adjusted under 35 U.S.C. 154(b) by 182 days.

(21) Appl. No.: 11/010,427

(22) Filed: Dec. 14, 2004

(65) Prior Publication Data

US 2006/0124502 A1 Jun. 15, 2006

(51) Int. Cl.
*B65D 83/04* (2006.01)
*G07F 11/00* (2006.01)
*A47G 19/24* (2006.01)

(52) U.S. Cl. ..... 206/539; 206/457; 206/534; 221/4; 222/142.9

(58) Field of Classification Search ..... 206/534, 206/538–539, 457, 459; 220/253, 525, 555; 215/6; 222/142.6–142.9, 132, 144.5; 221/4, 221/83

See application file for complete search history.

(56) References Cited

U.S. PATENT DOCUMENTS 611,136 A * 9/1898 Mason ..... 206/538
1,896,976 A * 2/1933 Schifferdecker ..... 220/253
3,358,818 A * 12/1967 Davis ..... 206/538
4,288,006 A * 9/1981 Clover, Jr. ..... 222/142.9
4,583,661 A * 4/1986 Clover, Jr. ..... 222/142.9
4,583,667 A * 4/1986 Fishman et al. ..... 222/142.6
5,167,338 A * 12/1992 Kick ..... 220/253
5,762,199 A * 6/1998 Aguilera ..... 206/538
5,845,816 A * 12/1998 Krane ..... 222/142.9
6,036,017 A * 3/2000 Bayliss, IV ..... 206/534
7,147,127 B2 * 12/2006 Lepke et al. ..... 221/4

* cited by examiner

*Primary Examiner*—Bryon P. Gehman
(74) *Attorney, Agent, or Firm*—Jacobson Holman PLLC

(57) ABSTRACT

The multiple compartment pill dispenser has a rotatable cap mechanism having two holes associated with the cap which are displaceable to be aligned with each of the compartments of the dispenser. There are two standard sized holes, one for small pills and one for large pills. The dial cap mechanism is used to rotate one of the two holes into alignment with a particular pill compartment and allow a pill to be dispensed therefrom. As a closure device, an alignment plate is rotatably mounted in the cap mechanism. The alignment plate also includes two different sized holes, identical in diameter, respectively, to the two holes in the cap mechanism.

14 Claims, 5 Drawing Sheets

MULTIPLE COMPARTMENT PILL DISPENSER

FIELD OF THE INVENTION

The present invention includes a bottle with two to six compartments to place different medicines into these compartments so that people who are traveling, or those individuals at home who require many different medications, would have a single pill dispensing bottle instead of several different pill bottles.

BACKGROUND OF THE INVENTION

With the aging of America, and increased usage of prescription medications, the population is using more and more different medications simultaneously. These medications are difficult to keep track of when each is maintained in its individualized dispensing bottle. It is even more difficult to keep track of these varied medications during travel.

There is therefore a need to provide a combined pill dispenser bottle for dispensing different medications from a single container while associating each particular medication with a pleasant scene or landscape and to provide a container which can accommodate different sized pills.

SUMMARY OF THE INVENTION

The multiple compartment pill dispenser of the present invention has a rotatable cap mechanism having two holes associated with the cap which are displaceable to be aligned with each of the compartments of the dispenser. There are two standard sized holes, one for small pills and one for large pills. The dial cap mechanism is used to rotate one of the two holes into alignment with a particular pill compartment and allow a pill to be dispensed therefrom. As a closure device, an alignment plate is rotatably mounted in the cap mechanism. The alignment plate also includes two different sized-holes, identical in diameter, respectively, to the two holes in the cap mechanism.

To remove a pill from a compartment it is necessary to first align one of the holes of the cap mechanism with a compartment. Then one of the holes of the alignment plate is placed coincident with the hole of the cap mechanism. Upon inversion of the dispenser, the pills of a compartment are allowed to pass through the hole of the cap mechanism first and then through the aligned hole of the alignment plate. Relative rotation of either of the cap mechanism or the alignment plate serves to secure the pills in each compartment.

This concept could also be used by pharmacists. Instead of having four or five different bottles in stock, they could have one bottle with a similar number of compartments and the cap mechanism and alignment plate of the present invention.

There is a designer label for each compartment on the side of the dispenser. For older people, the same size and color of a pill to be used would have large identifying indicia and large letters on each label associated with each compartment. In addition the label would have any design, such as a picture of Niagara Falls, or a forest, etc. with a pleasant color pattern. The indicia lines would extend vertically so that one could put the use directions onto the bottle on a side of the dispenser associated with the corresponding compartment.

By the present invention, the rotatable cap mechanism of the pill dispenser includes an integral plate with two openings extending across an upper opening of the dispenser. In addition, an alignment device is rotatably mounted in a groove of the rotatable cap mechanism and has two openings. The groove includes limit stops to control the amount of rotation of the alignment device.

The openings of the alignment device are the same size as the two openings of the integral plate of the rotatable cap mechanism. The alignment device includes a handle which is manually rotated with respect to the cap mechanism so as to align one of the openings of the alignment device with one of the openings of the integral plate of the cap mechanism. When one of the openings of the integral plate of an appropriate size is positioned above a correspondingly sized pill in one of the compartments and aligned with one of the openings of the alignment device, the pill from the corresponding compartment is allowed to be removed from the compartment of the pill dispenser.

It is therefore an object of the present invention to provide a multiple compartment pill dispenser having a rotatable cap mechanism with an integral plate having two openings and an alignment device rotatable within the cap mechanism for aligning an opening of the alignment device with an opening in the integral plate so as to dispense a pill from one of the compartments.

It is another object of the present invention to provide a multiple compartment pill dispenser having a rotatable cap mechanism with an integral plate having two openings and an alignment device rotatable within the cap mechanism for aligning an opening of the alignment device with an opening in the integral plate so as to dispense a pill from one of the compartments with the side of each compartment being illustrated with a pleasant scene or landscape and having indicia providing the name and frequency of use of the pills contained in the compartment.

It is still yet another object of the present invention to provide a multiple compartment pill dispenser having a rotatable cap mechanism with an integral plate having two openings and an alignment device rotatable within the cap mechanism for aligning an opening of the alignment device with an opening in the integral plate so as to dispense a pill from one of the compartments with the side of each compartment being illustrated with a pleasant scene or landscape and having indicia providing the name and frequency of use of the pills contained in the compartment and having an illustration of a specific pill contained within the compartment on the side of the pill dispenser.

It is still yet another object of the present invention to provide a multiple compartment pill dispenser having a rotatable cap mechanism with an integral plate having two openings and an alignment device rotatable within the cap mechanism for aligning an opening of the alignment device with an opening in the integral plate so as to dispense a pill from one of the compartments with the side of each compartment being illustrated with a pleasant scene or landscape and having indicia providing the name and frequency of use of the pills contained in the compartment and having an illustration of a specific pill contained within the compartment on the side of the pill dispenser with the alignment device being rotated and contained within a groove of the rotatable cap mechanism and with the cap mechanism including a projection extending into an accommodating recess in a side wall of the pill dispenser.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 2:
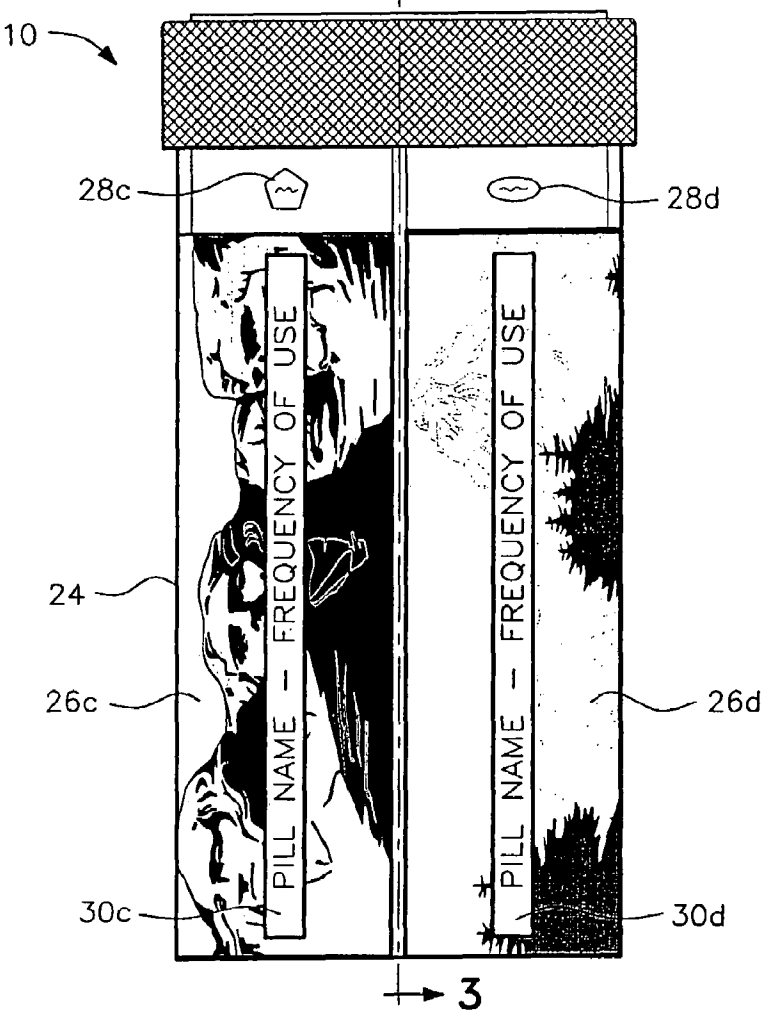
FIG. 2 is a side view opposite to that of FIG. 1 illustrating another portion of the side wall of the pill dispenser proximate to two other compartments of the pill dispenser.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 1:
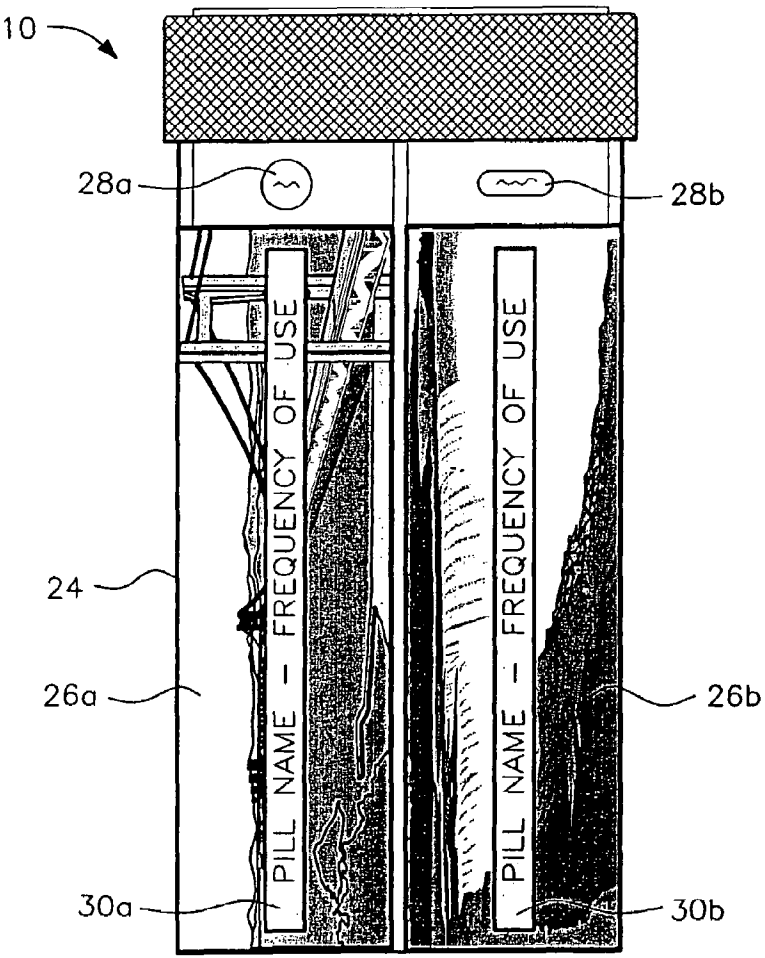
FIG. 1 is a side view of the outside of two compartments of the multiple compartment pill dispenser of the present invention.
Figure 3:
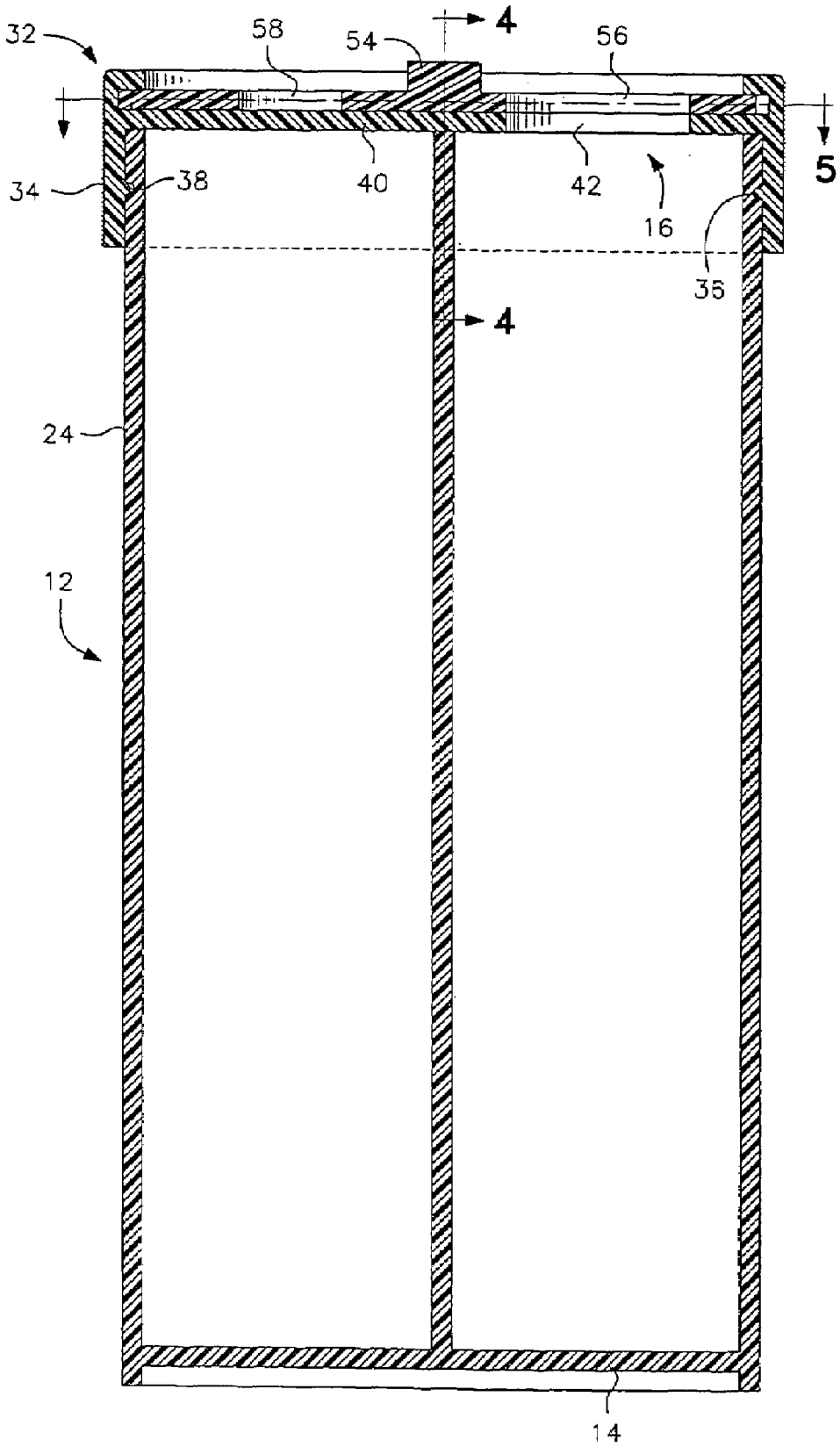
FIG. 3 is a sectional view taken along line 3—3 of FIG. 2.
Figure 4:
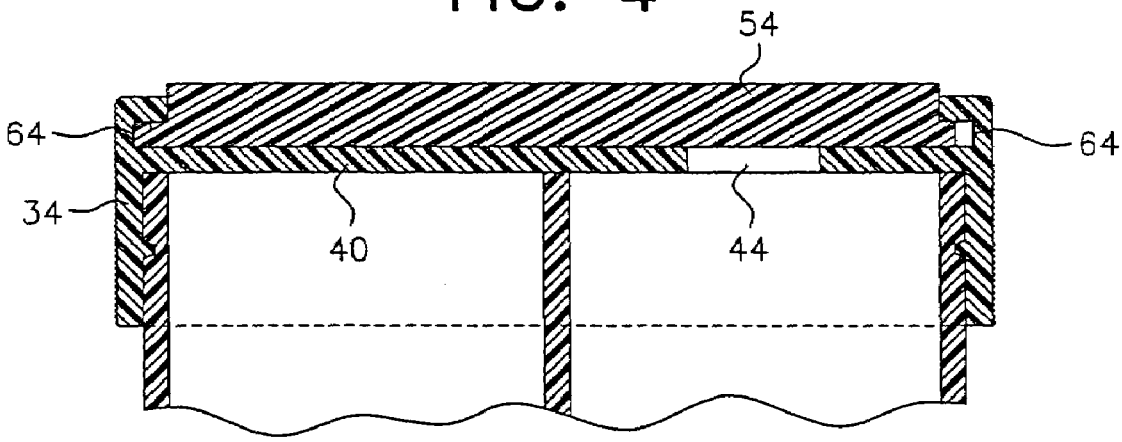
FIG. 4 is a sectional view taken along line 4—4 of FIG. 3.

With reference to the drawings, in general, and to FIGS. 1 through 3, in particular, a multiple compartment pill dispenser embodying the teachings of the subject invention is generally designated as 10. With reference to its orientation in FIG. 1, the multiple compartment pill dispenser includes a cylindrical hollow body 12 having a closed bottom 14 and an open top 16.

Extending from the bottom 14 to the top 16 are a plurality of compartments 18*a*, 18*b*, 18*c* and 18*d* which are separated by crossed segregating walls 20, 22, which extend from the bottom 14 to the top 16. In the embodiment shown, there are four compartments, it being understood as being within the scope of the present invention that there could be more or less compartments.

On an exterior side wall 24 of the body 12 are a plurality of scenes or landscapes 26*a*, 26*b*, 26*c* and 26*d*. These scenes are aligned with the exterior wall of each of the compartments 18*a*–18*d*, respectively. The scenes shown are of the Golden Gate Bridge, Niagra Falls, Mount Rushmore and a mountain landscape. These scenes can be selected by a patient to associate a certain landscape or scene with a particular pill contained in each compartment 18*a*–18*d*, respectively.

In addition, in each side wall section of the body 12 is an illustration 28*a*, 28*b*, 28*c* and 28*d* of the actual pill contained in each compartment 18*a*–18*d*, respectively. Further, extending vertically from the bottom 14 towards the top 16 of each side wall section is an area 30*a*, 30*b*, 30*c*, 30*d* which includes a printed name of the pill and directions for its use. The letters in these areas 30*a*–30*d* would be of a large font to assist in being readily viewed by a patient.

Therefore, for each different pill in each compartment 18*a* through 18*d*, there is an identifying scene or landscape, actual depictions of the pill and labeling indicia identifying the name and directions for use of the pill. This will help a patient differentiate between the various pills and when they should be taken.

To obtain release of a pill from a compartment within the body 12, a cap mechanism 32 is rotatably mounted on the open top 16 of the body 12. The cap mechanism includes a downwardly extending flange 34 circumferentially surrounding the open top 16 of the body 12. Projecting inwardly from the flange 34 is a projection 36 which is shaped complementary to a recess 38 located in the side wall 24 of the body 12. The cap mechanism is thereby allowed to freely rotate around the upper open end 16 of the body 12.

Integral with the cap mechanism is a dispensing plate 40 which extends across the open upper end 16 of the body 12. The plate 40 includes two round openings 42, 44. The diameter of opening 42 is larger than that of opening 44. Each of the openings is dimensioned to allow passage therethrough of a pill from one of the compartments 18*a* through 18*d*, depending upon the size of the pill in each compartment.

Rotatably mounted in the cap mechanism 32 is an alignment device 50. The alignment device includes a flat plate 52 and a handle 54. In plate 52 are two openings 56, 58 which are of an identical size to openings 42, 44, respectively, of the plate 40 of the cap mechanism 32. Projecting from a side edge 60 of plate 52 is a projecting cam portion 62.

The cap mechanism includes a radially outwardly extending groove 64 for receipt of alignment plate 52. Alignment plate 52 is rotatably mounted in the cap mechanism for alignment of one of the two openings 56, 58 with one of the openings 42, 44 of the cap mechanism. The projecting cam portion 62 is movable from the position shown in FIG. 5A to the position shown in FIG. 5B by rotation in a clockwise direction until the end surfaces 66, 68 of the cam portion 62 engage with stop walls 70, 72 of the groove 64 in the cap mechanism 32.

Figure 5A:
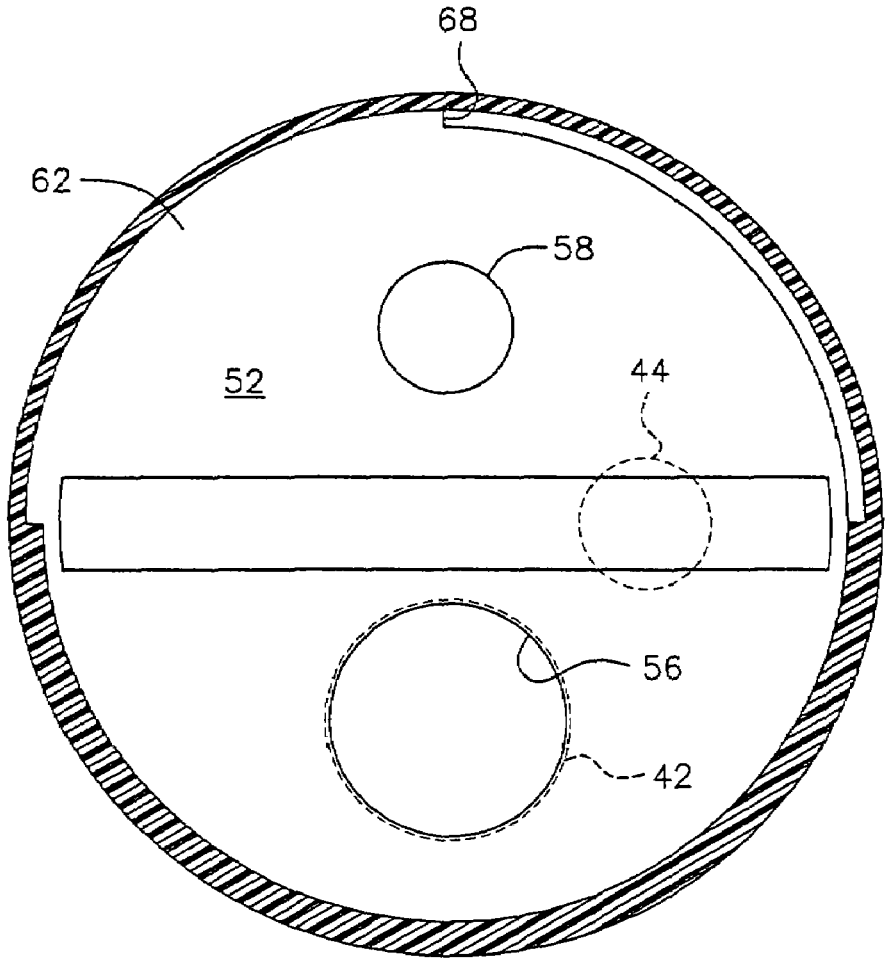
FIGS. 5A and 5B are sectional views taken along line 5—5 of FIG. 3 with FIG. 5A illustrating the rotation of a large opening of an alignment device being coincident with a large opening of an integral plate in the rotatable cap mechanism and FIG. 5B illustrating an alternate position of the alignment device so that a small opening of the alignment device is coincident with a small opening of the integral plate of the rotatable cap mechanism.
Figure 5B:
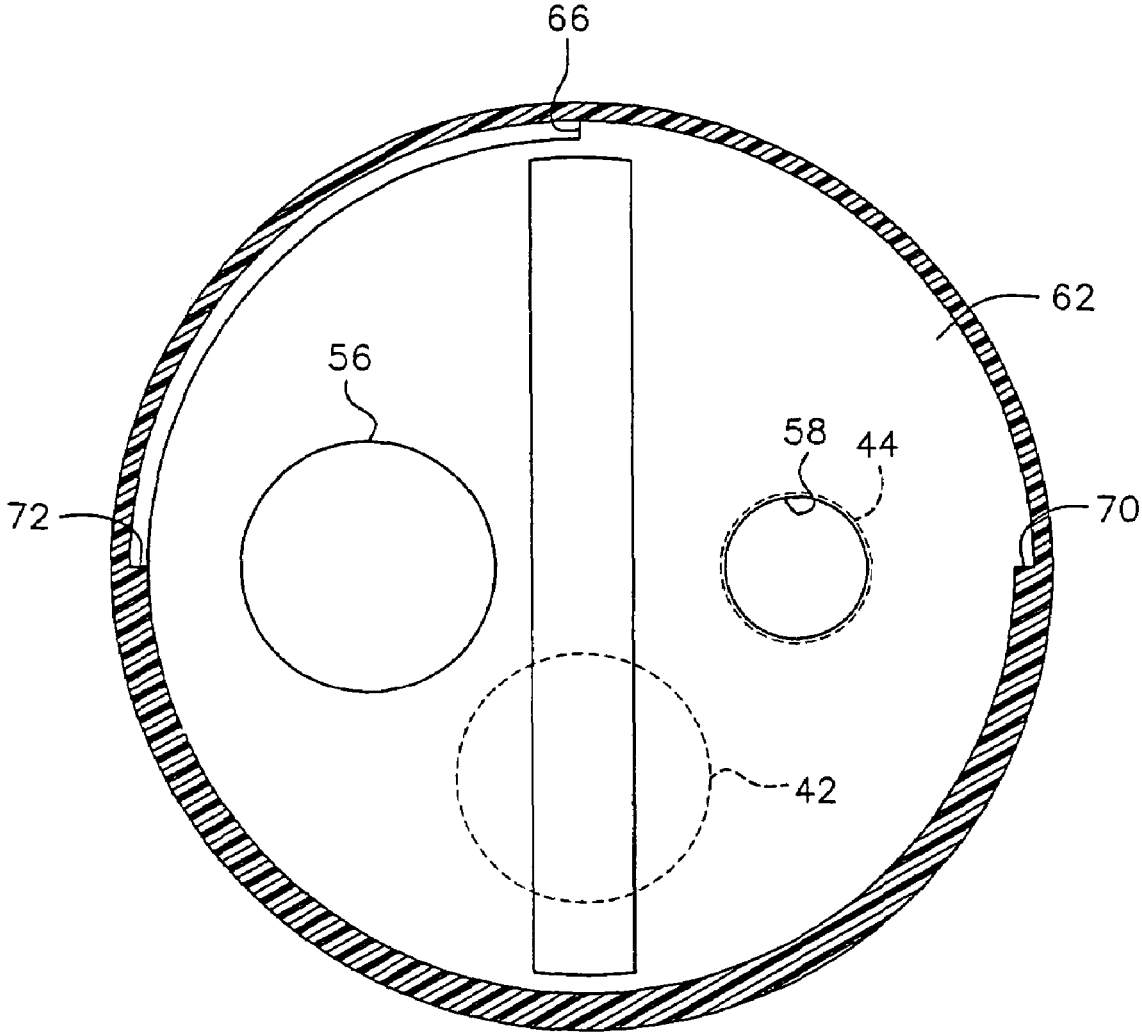
Figure 6:
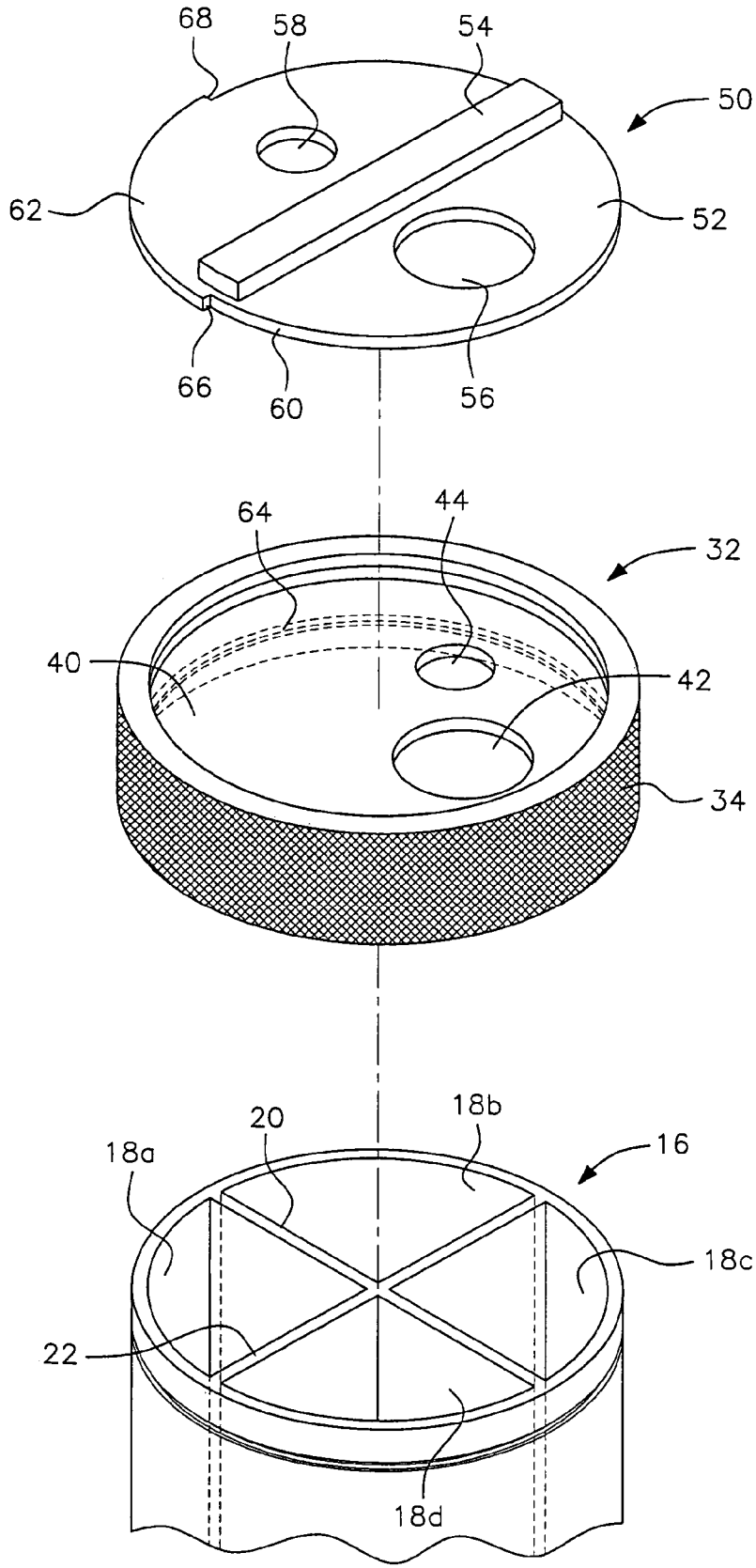
FIG. 6 is an exploded view of the multiple compartment pill dispenser of the present invention.

When, as shown in FIG. 5A, the cap mechanism 32 has been rotated so that the opening 42 is over one of the compartments 18*a* through 18*d*, the plate 52 is rotated so that the opening 56 is coincident with opening 42 to allow passage of a pill from one of the compartments 18*a* through 18*d* into the hand of a patient. Similarly, upon rotation of the cap mechanism 32 to a position with opening 44 over one of the compartments 18*a* through 18*d* as shown in FIG. 5B, the plate 52 is rotated by handle 54 until opening 58 is aligned with opening 44 to allow release of a pill from one of the compartments 18*a* through 18*d*.

By the rotation of the cap mechanism and independent rotation of the alignment device, a desired sized opening may be positioned over one of the plurality of compartments of a pill dispenser for release of a pill from the compartment. In addition, the depiction on the exterior of the bottle positively reminds the patient of the type of pill, name of the pill and frequency of use. This helps the patient maintain the proper usage of a plurality of different medications.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. A pill dispenser comprising:

a body having a closed bottom and an open top with a plurality of compartments extending from the bottom to the top for containing different pills, a cap mechanism mounted on the top of the body, the cap mechanism including a plate extending across the top of the body and having two openings; and an alignment device mounted in the cap mechanism, said alignment device having two openings for movement of the alignment device to have one of the openings of the alignment device coincide with one of the two openings of the cap mechanism to allow removal of a pill from one of the compartments of the body, the alignment device being rotatably mounted in the cap mechanism, the alignment device including a projection extending into a recess of the cap mechanism, and the recess including stops for controlling an amount of rotation of the alignment device with respect to the cap mechanism.

2. The pill dispenser as claimed in claim 1, wherein the cap mechanism is rotatably mounted on the body.

3. The pill dispenser as claimed in claim 2, wherein one of the body and the cap mechanism includes a projection and the other of the body and the cap mechanism includes a recess for rotation with respect to each other.

4. The pill dispenser as claimed in claim 1, wherein a sidewall of the body includes a scenic illustration of at least one of a historic site, a landmark and a landscape.

5. The pill dispenser as claimed in claim 4, wherein a number of scenic illustrations is equal to a number of compartments in the body.

6. The pill dispenser as claimed in claim 5, wherein each of the scenic illustrations include a depiction of a ill representative of a pill in a corresponding compartment.

7. The pill dispenser as claimed in claim 5, wherein the number of compartments in the body is four.

8. A pill dispenser for storage of a plurality of different medications, said pill dispenser comprising:

a body having a closed bottom and an open top with a plurality of compartments extending from the bottom ot the top for separately containing the different medications, a cap mechanism mounted on the top of the body, the cap mechanism including a plate extending across the top of the body and having two openings, and an alignment device mounted in the cap mechanism, said alignment device having two openings and a handle for movement of the alignment device relative to the body and relative to the cap mechanism to have one of the two openings of the alignment device of a same size as one of the two openings of the cap mechanism coincide with the one of the two openings of the cap mechanism to allow removal of a pill from one of the compartments of the body, the alignment device being rotatably mounted in the cap mechanism, the alignment device including a projection extending into a recess of the cap mechanism, the recess including stops for controlling an amount of rotation of the alignment device with respect to the cap mechanism.

9. The pill dispenser as claimed in claim 8, wherein the cap mechanism is rotatably mounted on the body.

10. The pill dispenser as claimed in claim 9, wherein one of the body and the cap mechanism includes a projection and the other of the body and the cap mechanism includes a projection and the other of the body and the cap mechanism includes a recess for rotation with respect to each other.

11. The pill dispenser as claimed in claim 8, wherein a sidewall of the body includes a scenic illustration of at least one of a historic site, a landmark and a landscape.

12. The pill dispenser as claimed in claim 11, wherein a number of scenic illustrations is equal to a number of compartments in the body.

13. The pill dispenser as claimed in claim 12, wherein each of the scenic illustrations include a depiction of a pill representative of a pill in a corresponding compartment.

14. The pill dispenser as claimed in claim 12, wherein the number of compartments in the body is four.

* * * * *